US006991025B2

(12) United States Patent
Beatenbough

(10) Patent No.: US 6,991,025 B2
(45) Date of Patent: Jan. 31, 2006

(54) CROSS-OVER RIB PAIR FOR HEAT EXCHANGER

(75) Inventor: Paul K. Beatenbough, Lyndonville, NY (US)

(73) Assignee: Dana Canada Corporation, Oakville (CA)

( * ) Notice: Subject to any disclaimer, the term of this patent is extended or adjusted under 35 U.S.C. 154(b) by 0 days.

(21) Appl. No.: 10/802,231

(22) Filed: Mar. 17, 2004

(65) Prior Publication Data

US 2005/0205245 A1 Sep. 22, 2005

(51) Int. Cl.
*F28D 1/02* (2006.01)

(52) U.S. Cl. ..... 165/152; 165/170; 165/146

(58) Field of Classification Search ..... 165/150, 165/151, 152, 153, 165, 167, 170, 176
See application file for complete search history.

(56) References Cited

U.S. PATENT DOCUMENTS

| | | | | |
|---|---|---|---|---|
| 3,258,832 A | | 7/1966 | Gerstung | |
| 4,249,597 A | | 2/1981 | Carey | |
| 4,470,455 A | | 9/1984 | Sacca | |
| 4,696,342 A | | 9/1987 | Yamauchi et al. | |
| 4,723,601 A | * | 2/1988 | Ohara et al. | 165/153 |
| 4,732,601 A | | 3/1988 | Hidai et al. | |
| 4,915,163 A | * | 4/1990 | Matsunaga et al. | 165/153 |
| 5,042,577 A | | 8/1991 | Suzumura | |
| 5,062,477 A | | 11/1991 | Kadle | |
| 5,111,877 A | | 5/1992 | Buchanan et al. | |
| 5,111,878 A | | 5/1992 | Kadle | |
| 5,172,759 A | * | 12/1992 | Shimoya et al. | 165/110 |

(Continued)

FOREIGN PATENT DOCUMENTS

| | | |
|---|---|---|
| CA | 2150437 | 11/1996 |
| JP | 62-087792 | 4/1987 |

OTHER PUBLICATIONS

International Search Report issued on corresponding PCT case PCT/CA2005/000401 dated May 27, 2005.

*Primary Examiner*—Terrell Mckinnon
(74) *Attorney, Agent, or Firm*—Ridout & Maybee LLP

(57) ABSTRACT

According to one example of the invention, there is provided a multipass plate pair for conducting a fluid in a heat exchanger. The plate pair includes first and second plates, each plate having at least two longitudinal columns of externally protruding obliquely angled ribs formed therein and separated by a longitudinal flat section extending from substantially a first end of the plate to a terminus spaced apart from a second end of the plate. Each plate includes, between the terminus and the second end, a turn portion joining the two longitudinal columns. The first and second plates are joined together with the longitudinal flat sections abutting each other and the columns of angled ribs cooperating to form undulating first and second internal flow channels there-through separated by the abutting longitudinal flat sections. The first and second internal flow channels each have an upstream area and a downstream area relative to a flow direction of an external fluid flowing over the plate pair. The turn portions of the plates cooperate to define at least a first internal flow path for directing fluid from the upstream area of the first internal flow channel to the downstream area of the second internal flow channel and a second internal flow path for directing fluid from the downstream area of the first internal flow channel to the upstream area of the second internal flow channel.

12 Claims, 4 Drawing Sheets

U.S. PATENT DOCUMENTS 5,409,056 A 4/1995 Farry, Jr. et al.
5,417,280 A * 5/1995 Hayashi et al. ..... 165/153
5,517,757 A 5/1996 Hayashi et al.
5,669,439 A * 9/1997 Hasegawa et al. ..... 165/153
5,692,559 A 12/1997 Cheong
5,810,077 A 9/1998 Nakamura et al.
6,098,706 A 8/2000 Urch
6,241,011 B1 6/2001 Nakamura et al.
6,378,603 B1 4/2002 Shimoya et al.
6,401,804 B1 * 6/2002 Shimoya et al. ..... 165/70

* cited by examiner

CROSS-OVER RIB PAIR FOR HEAT EXCHANGER

BACKGROUND OF THE INVENTION

This invention relates to heat exchangers that are formed from plate pairs in which an internal flow path through the plate pair is defined by cross-over ribs.

Heat exchangers are often formed from multiple plate pairs that are stacked and brazed, soldered, or mechanically or otherwise joined and sealed. In some applications, for example in refrigerant evaporator systems, heat exchangers are formed from stacked plate pairs that each define an internal U-shaped flow path for the refrigerant. In some plate pair heat exchangers outwardly projecting ribs provided on each of the plates of a plate pair cooperate to form the internal U-shaped flow path. In such a ribbed plate construction, the ribs on each plate are angled in a common direction, such that when two plates are arranged facing each other to form a plate pair, the internal groove provided by each rib on one plate crosses-over a number of the internal grooves provided by ribs on the facing plate, thereby forming the internal flow path. Typically, at the U-turn portion of the flow path, the angled ribs are longer in order to pass the fluid around the U-turn. Examples of cross-over rib heat exchangers can be seen in U.S. Pat. No. 3,258,832 issued Jul. 5, 1966 and U.S. Pat. No. 4,249,597 issued Feb. 10, 1981.

In conventional designs for U-shaped flow path cross-over rib heat exchangers, the internal fluid is subjected to a relatively large pressure drop at the turn-around portion of a plate pair flow path, relative to the total drop across the rest of the plate pair. Additionally, in conventional designs, the internal fluid is not always directed around the turn-around portion in the most efficient manner for promoting heat exchange. For example, fluid entering the turn-around zone may have different phase characteristics based on a relative location of the fluid within the internal flow path. In conventional cross-rib plate designs, fluid passing around the turn-around portion is indiscriminately mixed without regard for such differing characteristics. Thus, there is a need for a cross-rib type plate pair heat exchanger in which the pressure drop in transferring fluid around the turn-around portion is minimized and fluid is routed around the turn-around portion in a pattern that increases heat exchanger efficiency.

SUMMARY

According to one example of the invention, there is provided a multipass plate pair for conducting a fluid in a heat exchanger. The plate pair includes first and second plates, each plate having at least two longitudinal columns of externally protruding obliquely angled ribs formed therein and separated by a longitudinal flat section extending from substantially a first end of the plate to a terminus spaced apart from a second end of the plate. Each plate includes, between the terminus and the second end, a turn portion joining the two longitudinal columns. The first and second plates are joined together about peripheral edge sections thereof with the longitudinal flat sections abutting each other and the columns of angled ribs cooperating to form undulating first and second internal flow channels separated by the abutting longitudinal flat sections. The first and second internal flow channels each have an upstream area and a downstream area relative to a flow direction of an external fluid flowing over the plate pair. The turn portions of the plates cooperate to define at least a first internal flow path for directing fluid from the upstream area of the first internal flow channel to the downstream area of the second internal flow channel and a second internal flow path for directing fluid from the downstream area of the first internal flow channel to the upstream area of the second internal flow channel.

According to another example of the invention, there is provided a heat exchanger including an aligned stack of U-flow tube-like flat plate pairs for conducting an internal heat exchanger fluid between an inlet manifold and an outlet manifold. Each of the plate pairs has an inlet opening and an outlet opening for the internal fluid and an upstream edge and a downstream edge relative to a flow direction of an external fluid over the plate pairs. Each plate pair includes first and second interfacing plates each having a longitudinal axis and an end, each of the plates having a longitudinal upstream column of outwardly protruding ribs that are angled relative to the longitudinal axis, and a longitudinal downstream column of outwardly protruding ribs that are angled relative to the longitudinal axis, the upstream column starting at one of the inlet and outlet openings and terminating at a turn portion located adjacent the end and the downstream column starting at the other of the inlet and outlet openings and terminating at the turn portion, the upstream column being upstream of the downstream column relative to the flow direction of the external fluid. The turn portion includes first and second outwardly extending ribs. The first and second plates are joined together with the angled ribs in the upstream columns of each plate communicating in a cross-over arrangement to define an upstream internal flow channel for the internal fluid and the angled ribs in the downstream columns of each plate communicating in a cross-over arrangement to define a downstream internal flow channel for the internal fluid. The first outwardly extending ribs cooperate to provide a first internal flow path for the internal fluid between an upstream side of the upstream internal flow channel to a downstream side of the downstream internal flow channel, and the second outwardly extending ribs cooperate to provide a second internal flow path for the internal fluid between a downstream side of the upstream internal flow channel and an upstream side of the downstream internal flow channel.

According to another example of the invention, there is provided a U-flow plate pair for conducting an internal fluid therethrough for use in a multi-plate pair heat exchanger having an upstream side and a downstream side relative to flow of an external fluid between adjacent plate pairs of the heat exchanger. The plate pair includes first and second interfacing plates joined about peripheral edge sections and along elongated central sections thereof, the plate pair including an elongated upstream side located between an upstream edge of the plate pair and the joined central plate sections and a downstream side located between the joined central plate sections and a downstream edge of the plate pair. The upstream and downstream sides of the plate pair include a first internal flow channel and a second internal flow channel, respectively, defined by obliquely angled outwardly projecting interfacing ribs formed on the plates, the interfacing ribs on the first plate being oriented in an opposite direction than the interfacing ribs on the second plate. The plate pair includes a turn-around end defining a U-shaped first internal flow path connecting an upstream area of the first internal flow channel to a downstream area of the second internal flow channel, and a second internal flow path connecting a downstream area of the first internal flow channel to an upstream area of the second internal flow channel.

BRIEF DESCRIPTION OF THE DRAWINGS:

Example embodiments of the invention will now be described, with reference to the accompanying drawings, in which.

Like reference numerals are used throughout the Figures to denote similar elements and features.

DESCRIPTION OF EXAMPLE EMBODIMENTS

Figure 1:
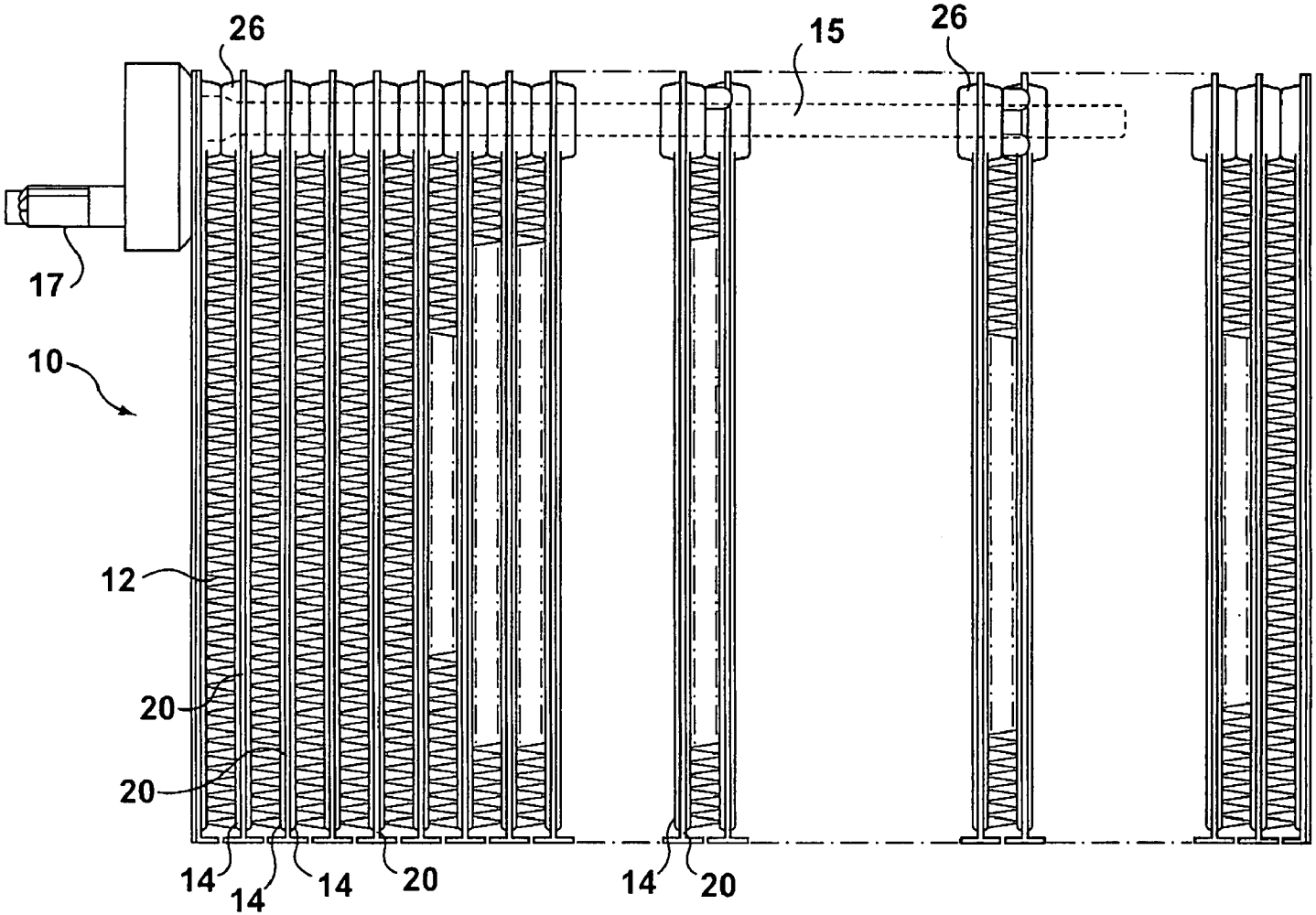
FIG. 1 is a side view of an example embodiment of a heat exchanger.

Referring to FIG. 1, an example embodiment of a heat exchanger, indicated generally by reference 10, is made up of a plurality of plate pairs 20 formed of back-to-back plates 14 of the type shown in FIGS. 2 to 5. Plate pairs 20 are stacked, tube-like members, formed from plates 14 having enlarged distal end portions or bosses 22, 26 having inlet 24 and outlet 28 openings, so that fluid flow travels in a generally U-shaped path through the plate pairs 20. In an example embodiment, air-side fins 12 are located between adjacent plate pairs 20. The bosses 22 on one side of the plates are joined together to form an inlet manifold and the bosses 26 on the other side of the plates are joined together to form an outlet manifold. The heat exchanger 10 may include a longitudinal inlet tube 15 that passes into the manifold openings 24 in the plates to deliver an incoming fluid, such as a two-phase, gas/liquid mixture of refrigerant, to one side of the heat exchanger 10. The heat exchanger 10 can be divided into multiple parallel plate pair sections, with fluid routed serially through the various sections to ultimately exit from an outlet fitting 17 located at the same end of the heat exchanger 10 as an inlet fitting. Alternatively, the outlet and inlet fittings may be located at different ends or in different locations of the heat exchanger. The actual circuiting used between plate pairs 20 is not critical and the plate pair configuration described herein can be used with many different configurations of U-flow stacked plate type heat exchangers. Although the heat exchanger 10 is shown in the Figures with the inlet and outlet manifolds upwards oriented, the heat exchanger 10 may often be oriented with the inlet and outlet manifolds downwards.

Figures 2, 3:
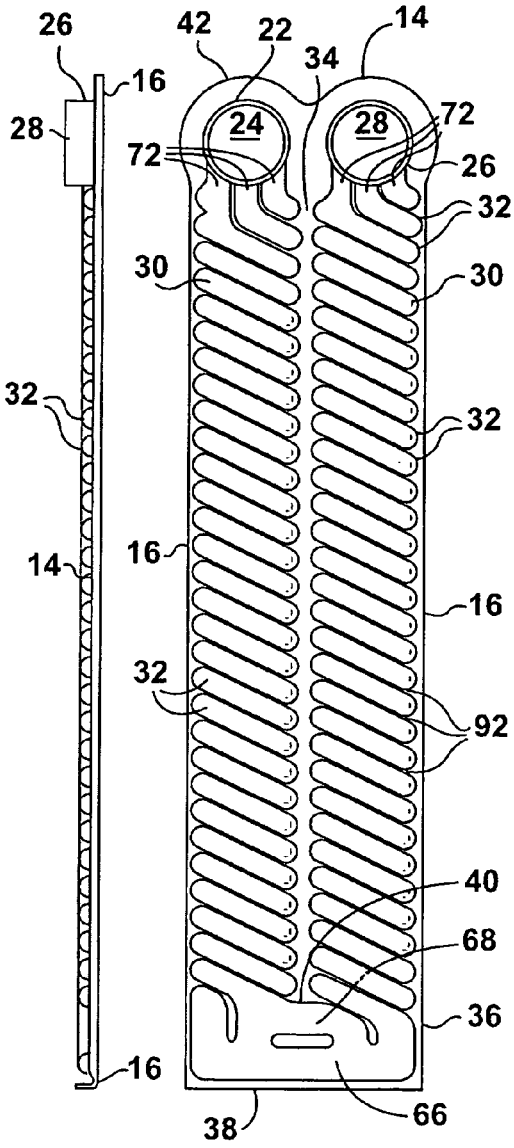
FIG. 2 is a first side edge view of a plate of the heat exchanger of FIG. 1.
FIG. 3 is an end view of the outside of a plate of the heat exchanger.
Figure 4:
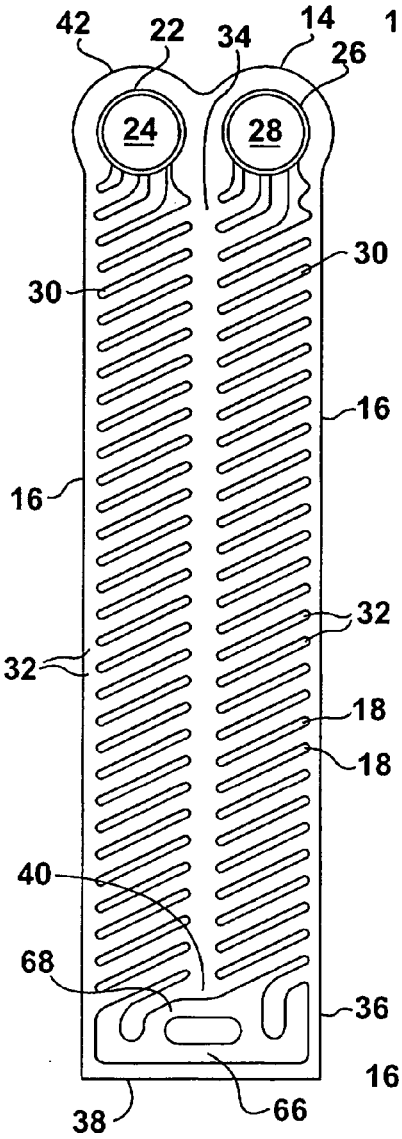
FIG. 4 is an end view of the inside of a plate of the heat exchanger.
Figure 5:
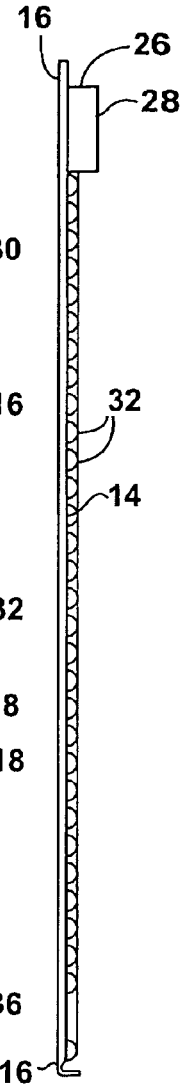
FIG. 5 shows the opposite side edge, relative to FIG. 2, of a plate of the heat exchanger.

With reference to FIGS. 2 to 7, each plate pair 20 is formed from a joined pair of elongated plates 14. In an example embodiment, the two plates 14 in a plate pair 20 are identical, with one plate being rotated 180 degrees about its longitudinal axis relative to the other. In this respect, FIG. 3 shows the outside of a plate 14, and FIG. 4 shows the inside of an identical plate 14 rotated 180 degrees relative to the plate shown in FIG. 3. The plates 14 of FIGS. 3 and 4 are joined together to form a plate pair 20. Each plate 14 is substantially planar, with a flat outer edge portion 16 extending about its periphery. Each plate 14 includes two longitudinal columns 30 of outwardly protruding obliquely angled ribs 32 that are separated by a longitudinal central flat section 34 that extends from a first or manifold end 42 of the plate to a terminus 40 that is spaced apart from a second end 38 of the plate. The central flat section 34 and the flat outer edge portion 16 are located in a substantially common plane, with ribs 32 protruding outward from such plane to define inwardly opening grooves 18. In an example embodiment, all of the ribs 32 on the plate 14 are oriented in a common direction, at an oblique angle relative to the elongate side edges of the plate. In some example embodiments, however, each column could include multiple sections of parallel ribs, with adjacent sections of ribs being oriented at different angles. The ribs 32 in each column 30 extend from the central flat section 34 out to a respective peripheral edge portion 16. Within each column, the ribs 32 are each separated by external valleys or grooves 92 that are in the same plane as flat outer peripheral section 16 and flat central section 34. The columns 30 of angled ribs 32 terminate prior to the second plate end 38, and each plate 14 includes a turn portion 36 between the central flat section terminus 40 and the second plate end 38.

The plates 14 of a plate pair 20 are sealably joined together with their respective peripheral edge portions 16 and central flat sections 34 aligned and abutting each other, and with the angled ribs 32 cooperating in a cross-over arrangement to form undulating first and second internal flow channels 44, 46 through the plate pair 20 on opposite sides of the central flat sections 34. The turn portions 36 in the plates 14 cooperate to provide a first or outer internal fluid flow path 62 and a second or inner internal fluid flow path 64 between the internal flow channels 44, 46.

Figure 7:
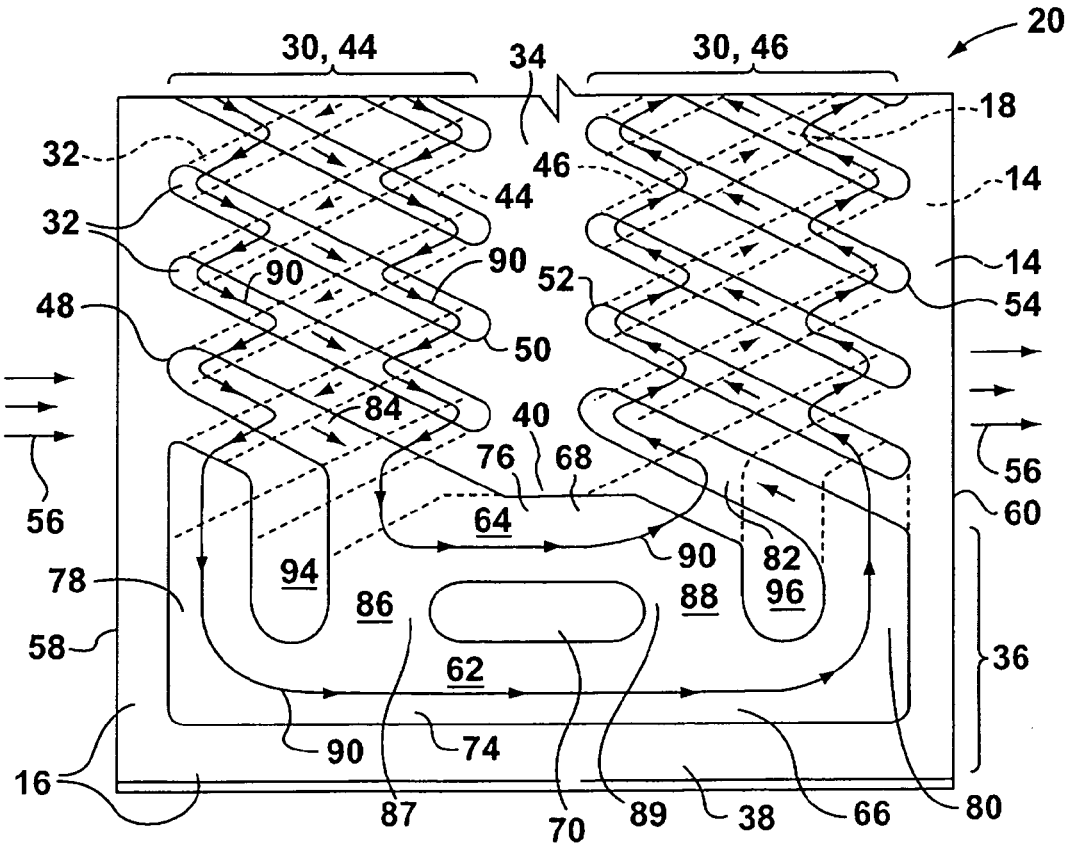
FIG. 7 is a partial end view of a plate pair of the heat exchanger.

FIG. 7 illustrates the cooperation of ribs 32 and turn portions 36 in a plate pair 20, with the ribs 32 of a hidden plate 14 of the plate pair being shown in phantom lines. When installed in a vehicle, the heat exchanger 10 will typically be oriented so that air will flow through the air side fins 12 between the plate pairs 20. Thus, with reference to FIG. 1, the direction of air flow will be substantially perpendicular to the surface of the paper. Turning again to FIG. 7, the direction of air flow over the outside of plate pair 20 is represented by arrows 56. Accordingly, relative to the direction of air flow travel, the plate pair 20 has a leading or upstream edge 58 and a trailing or downstream edge 60, first flow channel 44 being upstream of the second flow channel 46. As used herein, the terms "leading" or "upstream" and "trailing" or "downstream" are relative to direction of air flow through the plate pair 20, unless the context requires a different interpretation. In the illustrated embodiment, the ribs 32 of one of the plates 14 (the visible plate in FIG. 7) are all obliquely angled with their downstream rib ends closer to the turn-around end 38 of the plate than their upstream rib ends are. The ribs 32 of the other plate 14 (the hidden plate in FIG. 7) are all obliquely angled in an opposite direction with their upstream rib ends closer to the turnaround end 38 of the plate than their downstream rib ends are. In the illustrated embodiment, each rib 32 (except those ribs near the manifold end 42 and those near the turnaround end 38) crosses over or interacts with four ribs 32 on the other plate 14 of the plate pair 20. In other example embodiments, there may be more or less than four cross-over points between opposing ribs. As best seen in FIGS. 3 and 4, in the illustrated embodiment, three of the ribs 32 near the manifold end 42 are joined by joining ribs to 72 to the inlet and outlet openings 24, 28, thus providing a path for fluid to enter and exit the flow channels 44, 46.

The turn-around portions 36 of plates 14 of a plate pair 20, each include first and second outwardly protruding ribs 66, 68 that cooperate to provide the first and second internal flow paths 62 and 64, respectively, that connect the internal flow channels 44, 46. The first turn-around rib 66 is located closer to the outer edges of the plate 14 than the second turn-around rib 68. The first and second ribs 66, 68 each include central horizontal rib portions 74, 76, respectively, that are substantially parallel to each other and to the end 38 of the plate 14 and which are located between the terminus 40 of the central flat section 34 and the plate end 38. The central rib portions 74, 72 are interspaced by a flat diving section 70 that is in the same plane as peripheral edge section 16 and the central flat section 34 such that the flat dividing sections 70 of the plates 14 in a plate pair 20 abut together and separate central portions of the first and second internal flow paths 62 and 64 from each other. In the illustrated embodiment, the flat dividing sections 70 do not completely separate the flow paths 62 and 64, and short connecting paths 86 and 88 are provided between the flow paths 62 and 64.

As best seen in FIG. 7, a first vertical rib portion 78 extends substantially parallel to one longitudinal edge of the plate 14, orthogonally from one end of horizontal central rib portion 74, and a second vertical rib portion 80 extends substantially parallel to the opposite longitudinal edge of the plate 14 orthogonally from the other end of horizontal central rib portion 74. Vertical rib portions 78 and 80 are separated from the central rib portion 76 by vertical flat plate sections 94 and 96, which are in the same plane as edge section 16 and elongate central section 34. Angled rib portions 82 and 84, which are parallel to angled ribs 32, extend from rib portions 80 and 76, respectively, into respective rib columns 30. Rib portions 74, 78 and 80 of facing plates 14 of a plate pair 20 define the first flow path 62. The first flow path 62 is, in an example embodiment, U-shaped and closely follows the outer edges around the turn-around end of the plate pair 20, thereby ensuring that the internal fluid gets to the corner areas of the plate pair 14. Additionally, the outer first flow path 62 directs internal fluid from an upstream area 48 of the first flow channel 44 to a downstream area 54 of the second flow channel 46. The inner second flow path 64, which is also U-shaped in the presently described embodiment, directs internal fluid from a downstream area 50 of the first flow channel 44 to an upstream area 52 of the second flow channel 46, as indicated by the flow arrows 90 shown in FIG. 7.

When heat exchanger 10 is in use, for example as an evaporator, the temperature difference between the external air and an internal refrigerant fluid at the upstream side of the first flow channel 44 will typically be much greater than the temperature difference at the downstream side of the first flow channel 44, with the result that by the time the internal fluid reaches turn-around portion 36 the liquid phase component of the two phase internal fluid is concentrated more in the downstream area 50 of the first flow channel 44 than the upstream area 48.

In order to improve the evaporation rate, it is desirable to transfer as much of the liquid phase component of the internal fluid from the first flow channel 44 to the leading edge of the second flow channel 46, as the temperature differential between the external air and the internal fluid will typically be greater at the upstream edge of the second flow channel than the downstream edge thereof. The plate pair configuration described herein addresses this desirable feature by directing, through the inner flow channel 64, fluid from the downstream area 50 of the first flow channel 44 to the upstream area 52 of the second flow channel 46, and by directing through the outer flow channel 62, fluid from the upstream area 48 of the first flow channel 44 to the downstream area 54 of the second flow channel 46. This reduces mixing of the refrigerant fluid from the upstream and downstream areas of the first flow channel 44. In other words, in evaporator applications, the multiple turn-around flow paths of the presently described example embodiment directs the upstream portion of the first pass to the downstream portion of the second pass and the downstream portion of the first pass to the upstream portion of the second pass. As the upstream portion of the first pass is depleted of liquid refrigerant relative to the downstream portion because of the greater air-to-refrigerant temperature difference at upstream edge of a pass as compared to the downstream edge, it is beneficial to direct the relatively liquid rich downstream portion of the first pass to the upstream portion of the second pass to take advantage of the larger air-to-refrigerant temperature difference at the upstream edge of the second pass as compared to the downstream edge.

As indicated above, in some example embodiments short connecting paths 86 and 88 are provided between the flow paths 62 and 64. The connecting paths 86 and 88 are formed from externally protruding rib portions 87 and 89. As noted above and as shown in FIG. 1, in an example embodiment air side fins 12 are located between adjacent plate pairs. The fins are secured to and supported by the outer surfaces of ribs 32, 66 and 68. One function of rib portions 87 and 89 is to provide support for the external air fin 12 that would otherwise have a long unsupported distance if flat section 70 were extended all the way from plate area 94 to plate area 96. Generally, the mixing of fluid between first and second flow paths 62 and 64 through connecting paths 86 and 88 will be quite low as the paths 86 and 88 connect areas of substantially equal refrigerant pressure and the connecting paths 86 and 88 are generally perpendicular to flow paths 62 and 64. Thus, the refrigerant fluid flowing through the flow paths 62 and 64 substantially by-passes the connecting paths 86 and 88 such that flow paths 62 and 64 are effectively separate from each other in the turn-around end 36. In some embodiments, paths 86 and 88 are omitted.

In an example embodiment, turn-around ribs 66, 68 and the angled ribs 32 that feed into the turn-around ribs 66, 68 have cross-sectional dimensions that are selected to reduce pressure drop in the internal fluid flowing around the turn portion of the plate pair.

Figure 6:
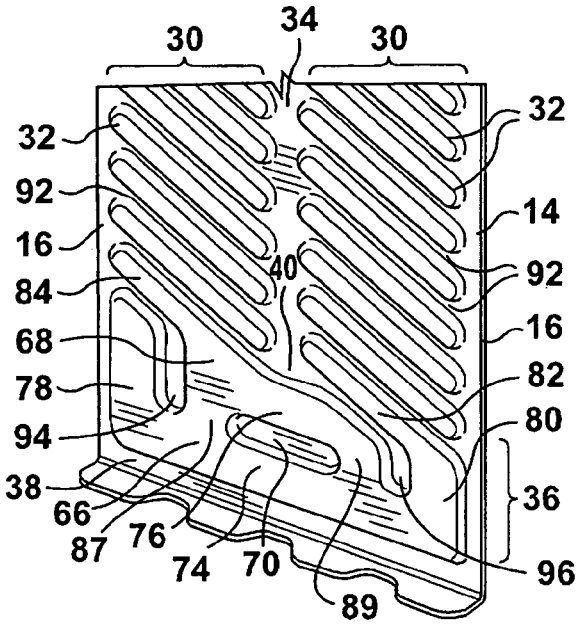
FIG. 6 is a partial perspective view showing the outside of a plate of the heat exchanger.

With reference to FIG. 6, as noted above, the ribs 32 are each separated by external valleys or grooves 92 that are in the same plane as flat outer peripheral section 16 and flat central section 34. An inner end of each groove 92 intersects with central section 34, and an outer end intersects with the outer peripheral section 16. This provides a continuous drainage surface such that condensate forming on the outer surface of the plate 12 can drain off through the grooves 92 (which will typically be spaced from the fin 12) to the downstream edge of the plate. In one example embodiment, ribs 32 have a larger external surface area than grooves 92, thereby increasing the surface area contact between the internal fluid carrying ribs 32 and the air-side fin 12.

In some embodiments, the heat exchanger 10 may have stacked plate pair sections in which the internal fluid flows in the opposite direction of that shown in FIG. 7, with the internal fluid first passing through the downstream or second flow channel 46, then through flow paths 62 and 64, and then into the upstream or first flow channel 44.

The plates 14 may be formed in a variety of ways—for example they could be made from roll formed or stamped sheet metal or from non-metallic materials, and could be brazed or soldered or secured together using an adhesive, among other things. Although the plates have been shown as having only two flow paths 62, 64 between the first and second flow channels 44, 46, more than two flow paths could be provided between the flow channels. The plates 14 have been shown as having two passes; however the turn portion configuration described herein could also be applied to plate pairs having more than one pass.

Figure 8:
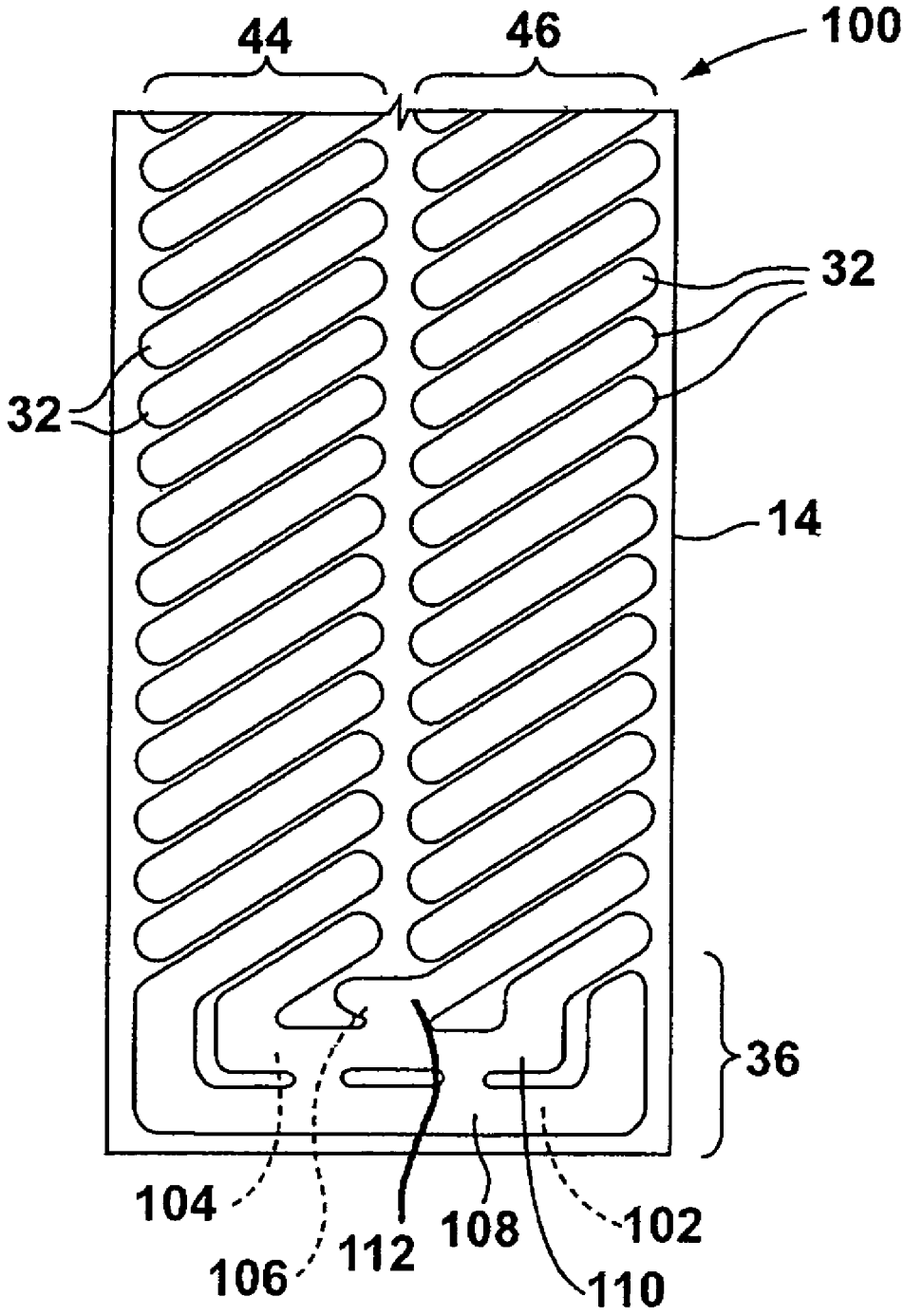
FIG. 8 is a partial end view of a further example of a plate for use in the heat exchanger.

In some example embodiments, more than two turn-around flow paths are provided between the first and second flow channels 44, 46. By way of example, FIG. 8 shows a further plate pair 100 that can be used in heat exchanger 10. The plate pair 100 is substantially identical to plate pair 20, except that the plates 14 are configured to provide three parallel flow paths 102, 104 and 106 connecting the first and second flow channels 44, 46. In the embodiment of FIG. 8, outwardly protruding ribs 108 formed on the interfacing plates 14 of the pair 100 cooperate to provide first U-shaped flow path 102 for directing fluid from the upstream side of first flow channel 44 to the downstream side of the second flow channel 46. Similarly, ribs 110 on interfacing plates 14 cooperate to provide second U-shaped flow path 104 for directing fluid from a middle area of the first flow channel 44 to a middle area of the second flow channel 46. Ribs 112 cooperate to provide third flow path 106 for directing fluid from a downstream side of the first flow channel 44 to an upstream side of the second flow channel 46. The use of additional flow paths allows for greater control over the transfer of fluid from specific exit areas of the first channel 44 to specific entry areas of the second channel 46. Generally, the choice between two, three, or more parallel flow paths will be related to the overall width of the plates and to the refrigerant mass flow rate (in an evaporator application). Depending on the application, relatively wide plates having high refrigerant flow rates may benefit from more parallel paths, whereas for narrower plates two paths may be sufficient.

As will be apparent to those skilled in the art in the light of the foregoing disclosure, many alterations and modifications are possible in the practice of this invention without departing from the spirit or scope thereof. The foregoing description is of the preferred embodiments and is by way of example only, and is not to limit the scope of the invention.

What is claim is:

1. A multipass plate pair for conducting a fluid in a heat exchanger, comprising:

first and second plates, each plate having at least two longitudinal columns of externally protruding obliquely angled ribs formed therein and separated by a longitudinal flat section extending from substantially a first end of the plate to a terminus spaced apart from a second end of the plate, each plate including, between the terminus and the second end, a turn portion joining the two longitudinal columns, the first and second plates joined together about peripheral edge sections thereof with the longitudinal flat sections abutting each other and the columns of angled ribs cooperating to form undulating first and second internal flow channels separated by the abutting longitudinal flat sections, the first and second internal flow channels each having an upstream area and a downstream area relative to a flow direction of an external fluid flowing over the plate pair, the turn portions of the plates cooperating to define at least a first internal flow path for directing fluid from the upstream area of the first internal flow channel to the downstream area of the second internal flow channel and a second internal flow path for directing fluid from the downstream area of the first internal flow channel to the upstream area of the second internal flow channel, the turn portion of each plate including a first outwardly protruding rib and a second outwardly protruding rib that each have central portions that are separated from each other by a flat dividing section and located between the terminus and the second end, the first ribs of the joined plates cooperating to provide the first internal flow path and the second ribs of the joined plates cooperating to provide the second internal flow path.

2. The plate pair of claim 1 wherein the central portions of the first and second ribs of each plate are substantially parallel to the second end of the plate.

3. The plate pair of claim 1 wherein the first rib includes a first rib portion extending substantially at a right angle from a first end of the central portion of the first rib and a second rib portion extending substantially at a right angle from a second end of the central portion of the first rib, the first rib portion of one plate cooperating with the second rib portion of the other plate of the plate pair.

4. The plate pair of claim 1 wherein the angled ribs in each column of the first plate each cross-over a plurality of ribs in the cooperating columns of the second plate, and the angled ribs in each column of the second plate each cross-over a plurality of ribs in the cooperating columns of the first plate.

5. The plate pair of claim 1 wherein the first and second flow channels extend substantially perpendicular to the flow direction of the external fluid over the plate pair.

6. A multipass plate pair for conducting a fluid in a heat exchanger, comprising:

first and second plates, each plate having at least two longitudinal columns of externally protruding obliquely angled ribs formed therein and separated by a longitudinal flat section extending from substantially a first end of the plate to a terminus spaced apart from a second end of the plate, each plate including, between the terminus and the second end, a turn portion joining the two longitudinal columns, the first and second plates joined together about peripheral edge sections thereof with the longitudinal flat sections abutting each other and the columns of angled ribs cooperating to form undulating first and second internal flow channels separated by the abutting longitudinal flat sections, the first and second internal flow channels each having an upstream area and a downstream area relative to a flow direction of an external fluid flowing over the plate pair, the turn portions of the plates cooperating to define at least a first internal flow path for directing fluid from the upstream area of the first internal flow channel to the downstream area of the second internal flow channel and a second internal flow path for directing fluid from the downstream area of the first internal flow channel to the upstream area of the second internal flow channel, wherein the first internal flow path extends around an outer area of a turn-around end of the plate pair and the second internal flow path is located internally of the outer area.

7. A heat exchanger including an aligned stack of U-flow tube-like flat plate pairs for conducting an internal heat exchanger fluid between an inlet manifold and an outlet manifold, each of the plate pairs having an inlet opening and an outlet opening for the internal fluid and an upstream edge and a downstream edge relative to a flow direction of an external fluid over the plate pairs, each plate pair comprising first and second interfacing plates each having a longitudinal axis and an end, each of the plates having a longitudinal upstream column of outwardly protruding ribs that are angled relative to the longitudinal axis, and a longitudinal downstream column of outwardly protruding ribs that are angled relative to the longitudinal axis, the upstream column starting at one of the inlet and outlet openings and terminating at a turn portion located adjacent the end and the downstream column starting at the other of the inlet and outlet openings and terminating at the turn portion, the upstream column being upstream of the downstream column relative to the flow direction of the external fluid, the turn portion including first and second outwardly extending ribs, the first and second plates being joined together with the angled ribs in the upstream columns of each plate communicating in a cross-over arrangement to define an upstream internal flow channel for the internal fluid and the angled ribs in the downstream columns of each plate communicating in a cross-over arrangement to define a downstream internal flow channel for the internal fluid, the first outwardly extending ribs cooperating to provide a first internal flow path for the internal fluid between an upstream side of the upstream internal flow channel to a downstream side of the downstream internal flow channel, and the second outwardly extending ribs cooperating to provide a second internal flow path for the internal fluid between a downstream side of the upstream internal flow channel and an upstream side of the downstream internal flow channel, the first and second internal flow paths each including separated central portions that are not parallel to the angled ribs.

8. The heat exchanger of claim 7 wherein the separated central portions of the internal flow paths each extend at substantially right angles to the longitudinal axis of the plates.

9. The heat exchanger of claim 7 wherein the plates are substantially planar with the ribs protruding outward therefrom, each plate having a flat peripheral edge section, a longitudinal flat central section extending between the upstream and downstream columns, and external grooves defined between the angled ribs, each of the external grooves intersecting at one end thereof with the flat central section and at an other end thereof with the flat peripheral edge section.

10. The heat exchanger of claim 9 wherein an external surface area of the angled ribs is greater than that of the external grooves.

11. The heat exchanger of claim 7 wherein the first plate is substantially identical to the second plate.

12. A heat exchanger including an aligned stack of U-flow tube-like flat plate pairs for conducting an internal heat exchanger fluid between an inlet manifold and an outlet manifold, each of the plate pairs having an inlet opening and an outlet opening for the internal fluid and an upstream edge and a downstream edge relative to a flow direction of an external fluid over the plate pairs, each plate pair comprising first and second interfacing plates each having a longitudinal axis and an end, each of the plates having a longitudinal upstream column of outwardly protruding ribs that are angled relative to the longitudinal axis, and a longitudinal downstream column of outwardly protruding ribs that are angled relative to the longitudinal axis, the upstream column starting at one of the inlet and outlet openings and terminating at a turn portion located adjacent the end and the downstream column starting at the other of the inlet and outlet openings and terminating at the turn portion, the upstream column being upstream of the downstream column relative to the flow direction of the external fluid, the turn portion including first and second outwardly extending ribs, the first and second plates being joined together with the angled ribs in the upstream columns of each plate communicating in a cross-over arrangement to define an upstream internal flow channel for the internal fluid and the angled ribs in the downstream columns of each plate communicating in a cross-over arrangement to define a downstream internal flow channel for the internal fluid, the first outwardly extending ribs cooperating to provide a first internal flow path for the internal fluid between an upstream side of the upstream internal flow channel to a downstream side of the downstream internal flow channel, and the second outwardly extending ribs cooperating to provide a second internal flow path for the internal fluid between a downstream side of the upstream internal flow channel and an upstream side of the downstream internal flow channel, each plate being substantially planar with the ribs protruding outward therefrom, each plate having a flat peripheral edge section, a longitudinal flat central section extending between the upstream and downstream columns, and external grooves defined between the angled ribs, each of the external grooves intersecting at one end thereof with the flat central section and at an other end thereof with the flat peripheral edge section, the heat exchanger further including external fins located between adjacent plate pairs in contact with the outer surfaces of the ribs thereof.

* * * * *